United States Patent [19]

Spears, Jr. et al.

[11] 4,008,568

[45] Feb. 22, 1977

[54] COMBUSTOR SUPPORT

[75] Inventors: Esten W. Spears, Jr., Indianapolis; Eugene R. Young, Plainfield, both of Ind.

[73] Assignee: General Motors Corporation, Detroit, Mich.

[22] Filed: Mar. 1, 1976

[21] Appl. No.: 662,434

[52] U.S. Cl. ..... 60/39.32; 60/39.65; 431/352; 431/353

[51] Int. Cl.[2] ..... F02C 3/00; F02C 7/20

[58] Field of Search ..... 60/39.32, 39.65, 39.69, 60/39.31; 431/352, 353

[56] References Cited

UNITED STATES PATENTS

| | | | |
|---|---|---|---|
| 2,555,965 | 6/1951 | Garber | 60/39.32 |
| 3,064,425 | 11/1962 | Hayes | 60/39.65 |
| 3,169,367 | 2/1965 | Hussey | 60/39.65 |
| 3,656,298 | 4/1972 | Wade | 60/39.65 |
| 3,880,575 | 4/1975 | Cross et al. | 60/39.65 |
| 3,924,403 | 12/1975 | Irwin | 60/39.65 |

*Primary Examiner*—Carlton R. Croyle
*Assistant Examiner*—Robert E. Garrett
*Attorney, Agent, or Firm*—J. C. Evans

[57] ABSTRACT

A combustor assembly includes a porous, laminated metal dome and an elongated tubular body portion disposed vertically within an air supply plenum. The dome and body portion are joined by a yieldable ring and a plurality of radially inwardly directed convolutions on one end of the body portion. A load support member is telescoped over the upper end of the dome and includes a tubular axial extension with a plurality of radially inwardly directed convolutions connected to the body portion and wherein the support member includes a plurality of radially outwardly directed spider arms extending from a support flange on the upper end of the support member secured to a fixed fuel nozzle pad whereby the porous laminated metal dome is supported for free flex movement with respect to the pad during combustor operation.

2 Claims, 6 Drawing Figures

COMBUSTOR SUPPORT

This invention relates to gas turbine engine combustor assemblies and more particularly to gas turbine combustor assemblies supported vertically within an air supply plenum.

Gas turbine combustion apparatus of the type set forth in U.S. Pat. No. 3,656,298, issued Apr. 18, 1972, to Wade, is characterized by the provision or a casing for supply of compressed air into a combustion liner mounted vertically within the air supply plenum to supply combustion products through a transition scroll to a turbine nozzle which directs motive fluid across turbine blades formed on the circumference of a turbine wheel. In such arrangements, the cumbustor liner is characterized by having a tubular axial portion for supply of primary and secondary air into the combustion chamber. The upper end of the tubular liner is closed by a perforated dome through which primary air is directed into the combustion chamber. Fuel supply to the burner is directed through a fuel nozzle mounted in a ferrule fixedly secured to the plenum case and to the perforated dome.

While such arrangements are suitable for their intended purpose, in some cases it is desirable to isolate the dome portion of the combustor assembly from thermally induced stress produced during combustor operation.

Accordingly, an object of the present invention is to provide an improved combustor assembly for use in gas turbine engines wherein a combustor assembly is located vertically within an air supply plenum and connected to the outer casing of the air supply plenum at the nozzle support pad portion thereof by a common ferrule by the provision of means for supporting one end of the dome portion of the assembly to a liner portion by a flex ring including a first plurality of circumferentially formed convolutions between the dome and a tubular liner portion depending therefrom and to include a load support member fixedly secured to the nozzle support pad at one end thereof and located in telescoping spaced relationship to the dome portion of the burner and including a second plurality of convolutions thereon secured to the tubular portion of the burner liner at a point spaced vertically below the first plurality of convolutions and wherein the nozzle for supplying fuel to the combustor assembly is directed through the top flange of the load support member and through a transversely movable ring supported on the dome to permit freedom of movement of the dome with respect to the remainder of the combustor assembly during combustion operation without imposition of thermal stress loading thereon.

Still another object of the present invention is to provide an improved combustor apparatus of the type including an outer casing defining a plenum space for flow of compressed air into a combustor liner and wherein the combustor liner is located vertically within the plenum and includes a porous dome and a side wall or body portion depending vertically below the dome and wherein a lower edge portion on the dome has a flex ring thereon joined to a first plurality of convolutions formed on an upper edge portion of the side wall of the liner and the dome includes a centrally located nozzle opening therein having a free floating ring secured thereto for supportingly receiving a nozzle for free movement with respect to the dome and wherein the liner is fixedly supported to a nozzle pad portion of the outer casing at the top thereof by a load support member telescoped over the dome and including a side wall thereon with a lower edge secured to the side wall of the liner by a second plurality of convolutions at a point vertically below the upper edge thereof to locate the side wall of the load support member in radially spaced relation to the dome and wherein the load support member includes a flange on the upper end thereof secured to the nozzle pad and further includes a plurality of radially outwardly directed spider arms connecting the flange to the side wall segment thereof to define a plurality of circumferentially spaced large area openings for primary air flow to the upper surface of the porous dome and wherein the side wall portion of the load support member further includes a plurality of circumferentially spaced air flow openings for directing air from the plenum into a plurality of radially inwardly directed side openings in the dome immediately above the lower edge thereof and wherein the first and second plurality of convolutions and the freely floating ring serve to permit freedom of movement of the porous dome with respect to the rigid nozzle support pad without imposition of excessive stress thereon during combustor operation.

Further objects and advantages of the present invention will be apparent from the following description, reference being had to the accompanying drawings wherein a preferred embodiment of the present invention is clearly shown.

Figure 1:
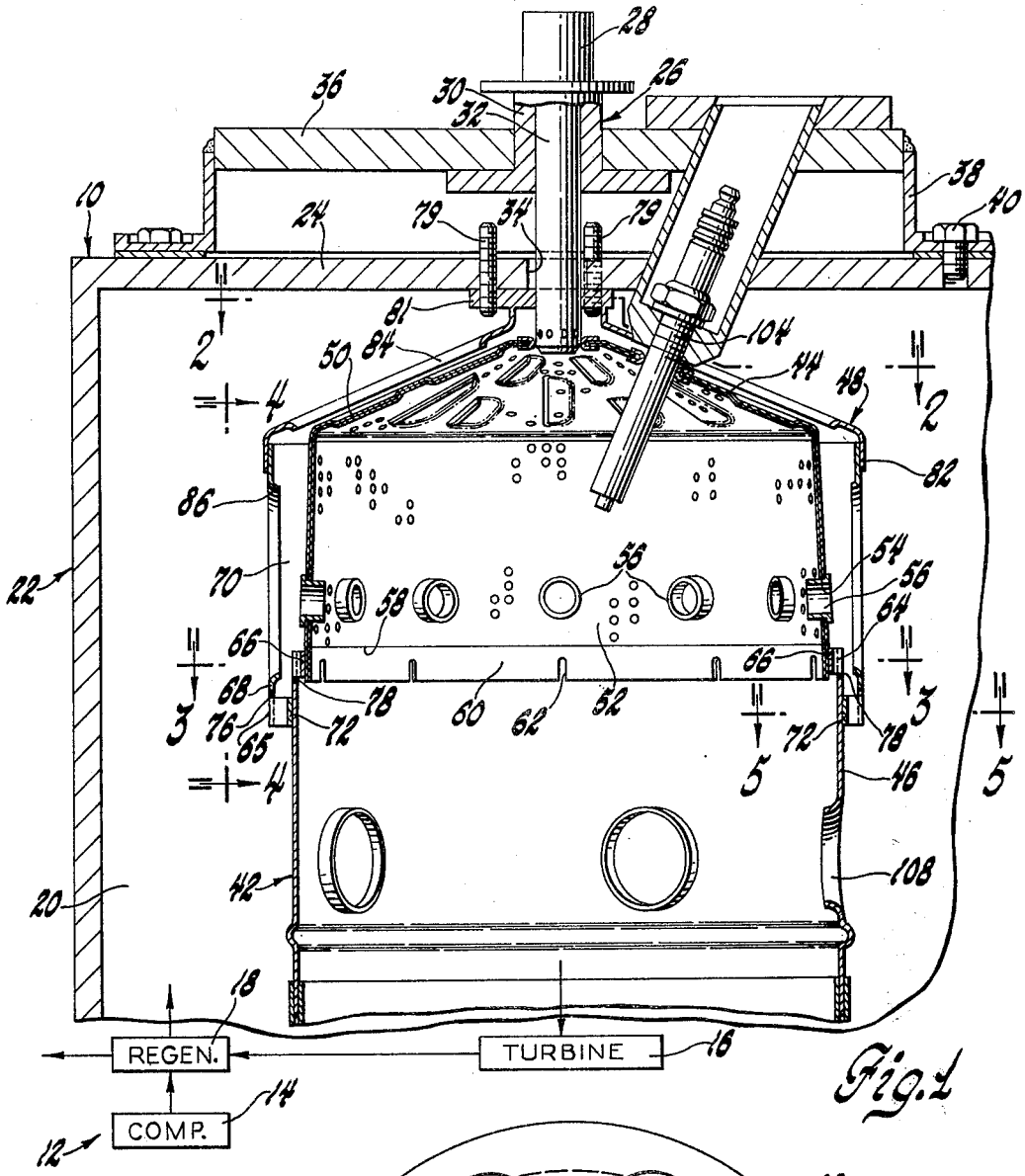
FIG. 1 is a view in vertical section showing the combustor and support assembly of the present invention.

Referring now to the drawings, in FIG. 1 a combustion apparatus 10 is shown in association with a diagrammatically illustrated gas turbine engine 12 including a compressor 14 driven by a turbine 16. Flow from the compressor 14 is through a regenerator 18 to an air supply plenum 20 formed by an outer casing 22 of the combustion apparatus 10. The outer casing 22 includes an upper pad 24 for a fuel supply assembly 26. The fuel supply assembly 26 includes a coupling 28 for connection to a fuel supply. A fitting 30 has a fuel distribution nozzle 32 supported thereon directed through an opening 34 in the upper plate 24. The fitting 30 is rigidly supported on the pad 24 by means including a plate 36 and a side wall 38 that is connected to the plate 24 by suitable fastening means representatively shown as screw elements 40.

The nozzle 32 directs fuel into a combustion liner 42. The combustion liner includes an upper dome portion 44 and a vertically aligned, dependent side wall or body portion 46 both disposed vertically within the plenum 20 and having the side wall portion 46 adapted to be mounted upon a transition duct or scroll for flow of combustion products generated within the liner 42 through an annular turbine nozzle which directs gas onto blades on the circumference of a turbine wheel within the turbine 16. In such arrangement, the turbine wheel is connected by a shaft to drive the compressor 14 as is more specifically set forth in the aforementioned U.S. Pat. No. 3,656,298. In such arrangements the exhaust of the turbine flows through the regenerator 18. Because of the hotter combustion air in the regenerative type engine the combustion system of the present invention has particular advantage. However, it is also applicable to turbine engines wherein a regenerator is omitted.

The gas turbine engine, while being illustrated as a single shaft engine, may be of various types, for example, it may be of the well known free turbine types in which the output shaft is driven by another turbine in the motive fluid path rather than by a turbine such as turbine 16 shown diagrammatically in FIG. 1.

In accordance with the present invention, the combustion liner 42 is supported with respect to the nozzle pad 24 by a unique support system 48 that enables the dome 44 to shift laterally and vertically with respect to the pad 24 thereby to reduce thermally induced stresses therein. This invention is especially suited for use with domes 44 made of laminated porous metal configurations. The provision of a porous laminated structure in the dome permits the air supply plenum 20 to permeate the combustor liner 42 in the vicinity of the dome 44 thereby to produce film cooling thereof which isolates the dome from extremely hot combustion products that are produced within the interior of the liner 42. In the illustrated embodiment the dome 44 is preferably fabricated from a three layer porous laminated material of the type set forth more specifically in U.S. Pat. No. 3,606,573, issued Sept. 20, 1971, to Emmerson et al. It can also be in the form of a ceramic material of porous composition to produce film cooling in the vicinity of a hot combustion zone. Both dome configurations may have a lesser structural strength characteristic than that of the side wall portion 46 of the liner 42. Accordingly, the support system 48 is configured to connect the combustor liner 42 to the pad 24 through the higher strength side wall portion 46 and to effectively structurally isolate the dome 44 and support it for free relative movement both vertically and transversely with respect to the pad 24.

The dome 44 includes a plurality of louvers 50 directed therethrough at circumferentially spaced points on its top and radially thereacross to form a pattern for primary air flow into a combustion zone 52 within the dome 44. Additionally, the dome 44 includes a plurality of circumferentially spaced side holes 54 therein each having a tubular flanged fitting 56 therethrough for directing combustion air radially inwardly of the combustion zone 52 at a point spaced axially above a lower edge 58 on the dome 44. A circumferential connection ring 60 is secured to the edge 58. It includes a plurality of slots 62 at circumferential points therearound and serves as a structural transition to freely support the dome 44 on the upper end 64 of the side wall portion 46.

Figure 3:
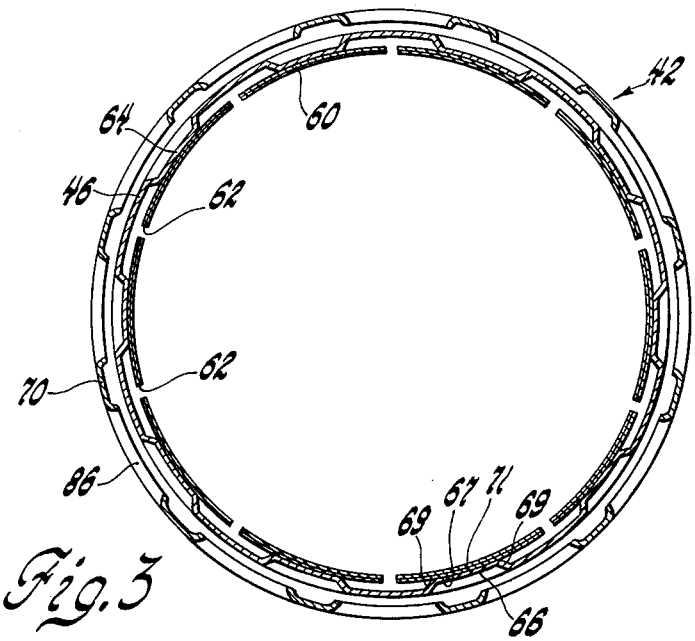
FIG. 3 is a horizontal sectional view taken along the line 3—3 of FIG. 1 looking in the direction of the arrows.
Figure 4:
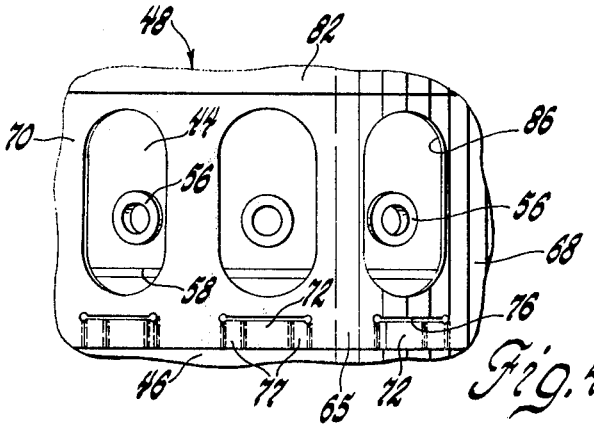
FIG. 4 is a fragmentary side elevational view taken along the line 4—4 of FIG. 1 looking in the direction of the arrows.
Figure 5:
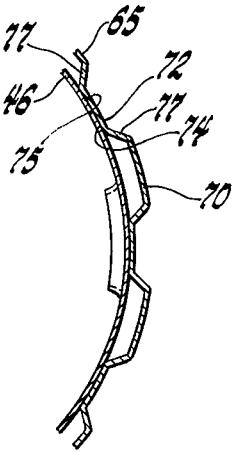
FIG. 5 is a fragmentary horizontal sectional view taken along the line 5—5 of FIG. 1 looking in the direction of the arrows.
Figure 6:
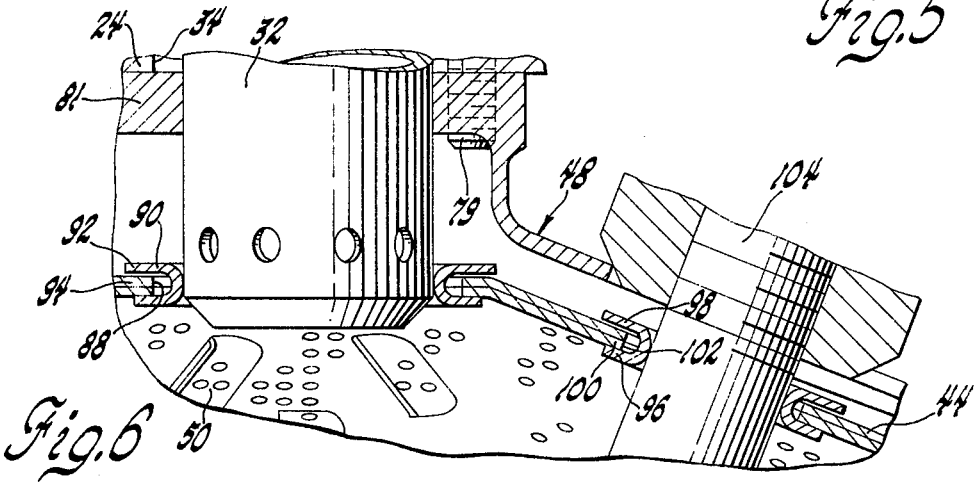
FIG. 6 is an enlarged, fragmentary sectional view of float ring components of the present invention.

As best shown in FIG. 3, the side wall portion 46 includes a plurality of circumferentially spaced, radially inwardly directed convolutions 66 thereon which are fixedly secured to juxtaposed surfaces 67, 71 formed respectively on the transition ring 60 and the upper end 64 of the side wall 46. Each convolution 66 has side flex segments 69. Direct connection of the combustor liner assembly 42 to the pad 24 is established at the lower edge 66 of a side wall support plate 68 of a spider support member 70 which is located circumferentially around and radially outwardly of the outer surface of the side wall of the dome 44. The side wall portion 68 includes a plurality of radially inwardly directed convolutions 72 thereon which are connected at juxtaposed surface segments 74, 75 formed respectively on the convolutions 72 and the outer surface of the side wall 46 at a point vertically below the upper end 64 thereof as best shown in FIGS. 1, 4 and 5. Each convolution 72 has side flex segments 77. The end 65 of the side wall 68 is slotted at 76 immediately above each of the convolutions 72. Likewise, the upper end 64 of the side wall 46 is slotted at 78. The convolutions 66, 72 and slots 76, 78 together form a connection for expansion between the higher strength liner side wall 46 and the support member 70 so that the dome 44 of the combustion liner 42 is free to expand with respect to the fuel supply assembly 26.

Figure 2:
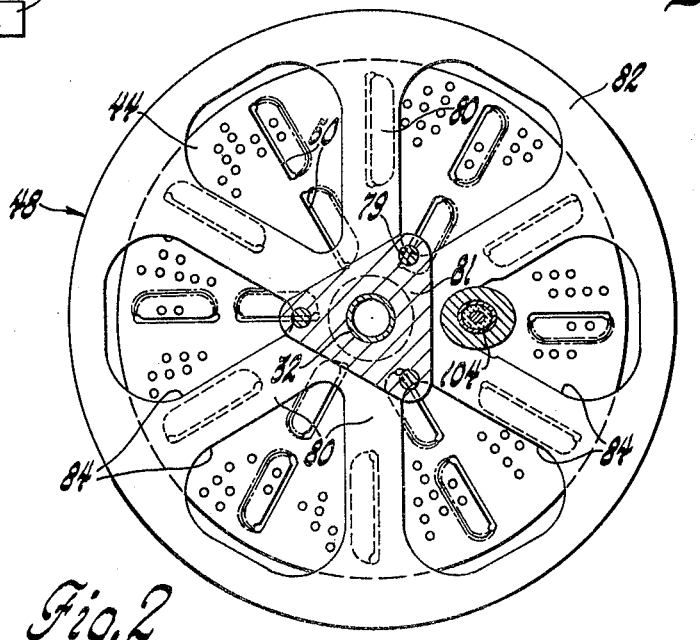
FIG 2 is a horizontal sectional view taken along the line 2—2 of FIG. 1 looking in the direction of the arrows.

The fixed connection of the support member 48 to the pad 24 is accomplished by means of a flange 81 having a triangular configuration as shown in FIG. 2. It is rigidly secured to the nozzle pad 24 by suitable fastener means representatively shown as screw elements 79. A plurality of radially outwardly directed spider arms 80 extend from flange 81 and are connected to a continuously formed, dependent circumferential flange 82 that connects to the upper edge of side wall portion 68 of the support member 70.

The arms 80 are spaced apart to form a plurality of large area openings 84 for flow of combustion air from the plenum 20 to the upper louvers 50 of the burner assembly 44 into the combustion zone 52. They further serve to rigidly connect the high strength burner liner side wall portion 46 vertically and transversely with respect to the nozzle pad 24.

The side wall 68 includes a plurality of circumferentially spaced, oval openings 86 therein for directing air flow from the air supply plenum 20 into the combustion zone 52 through the circumferentially spaced tubular air inlet fittings 54.

The support member 70 thereby serves to distribute combustion air uniformly into the region of the dome 44 of the combustor liner 42 and further serves as a structural support for the high strength liner portion 46 for positioning it both vertically and transversely with respect to the rigid nozzle pad 24.

As pointed out above, the convolutions 66, 72 support the dome 44 for both transverse and axial expansion with respect to the support member 70. As a result, the porous material of the liner 44 is able to expand freely without excessive stress buildup by thermal expansion. To further accommodate such expansion the dome 44 includes a nozzle access opening 88 therein having a float ring 90 with a channel-shaped outer flange 92 thereon supportingly fit over a circumferential edge portion 94 of the dome 44 located centrally thereof. The float ring 90 is loosely fit on the edge portion 94 to freely shift within the opening 88. The nozzle 32 is directed through the ring 90 and any relative lateral movement between the dome 44 and the system 26 is accommodated by freedom of movement between the ring 90 and the edge 94 in a lateral direction as well as in a vertical direction as provided by dimensioning the vertical height of channel flange 92 greater than the vertical height of the edge portion 94. Likewise, a second expansion accommodation float ring 96 has an outer circumferential channel 98 formed thereon and fit over a circumferential edge portion 100 of an opening 102 therein. The ring 96 serves as an access opening for an igniter assembly 104 which is rigidly connected to the nozzle pad 24. Ring 96 permits free lateral and vertical movement of the dome 44 at the igniter assembly 104 during combustion operation.

By virtue of the present arrangement, when the combustor is operated in temperature ranges of 1800° F the structure including the support member 70 and the expansion accommodation ring members 90, 96 permit the liner assembly 42 to grow both vertically and transversely while freely supporting the dome portion 44 with respect to the ground point represented by the nozzle pad 24. When the combustor assembly 10 is cooled, tendencies to produce tensile stresses on the dome 44 are compensated by the fact that the spider configured arms 80, the convolutions 66 and convolutions 72 will yield axially to permit contraction between the fixed point represented by the higher strength side wall portion 46 and the nozzle pad 24. Additionally, the expansion rings 90, 96 will accommodate axial foreshortening of the burner liner assembly 42 when the combustor assembly is cool.

The proportions of air admitted in various parts of the liner 42 may vary depending upon design choices including the turbine operating temperature, the presence or absence of a regenerator and other factors. In the illustrated combustor liner configuration approximately 14.4% of the total air discharged by the compressor 12 flows through the dome 44 (9.3% through dome pores and 5.1% through louvers 50). About 22.7% of the compressor discharge is admitted as primary air (13.7% through fittings 56 and 9% through convolutions 66). Approximately 14.9% of the total air is through side slots 78 in the side wall portion 46 at a point axially spaced below the dome 44 for side wall cooling. Dilution air flow of 48.1% of total air is through side openings 108 in wall 46.

In the illustrated embodiment the overall diameter of the high strength side wall liner portion 46 if 7.60 inches and the interior diameter of the dome at the side wall thereof is 7.25 inches. The circumferential openings 86 in the side wall 68 of the member 70 are formed at 12 places around the circumference thereof and in the illustrated embodiment, six openings are formed between the spider arms 80 and the side flange 82 of the member 70. In addition to providing a solid support of the high strength portion of the combustion liner 42 with respect to the ground point represented by the nozzle pad 24, the member 70 serves to direct combustion air uniformly into the liner 42 while permitting free expansion of the liner assembly 42 with respect to the dome 44 without imposition of excessive stress loading thereof.

While the embodiments of the present invention, as herein disclosed, constitute a preferred form, it is to be understood that other forms might be adopted.

The embodiments of the invention in which an exclusive property or privilege is claimed are defined as follows:

1. A combustor support assembly for vertically supporting axially aligned combustor dome and liner segments on nozzle support pad comprising a spider support member having a top flange at one end thereof with a central opening adapted to receive a fuel distribution nozzle and a peripheral flange of the other end thereof, means on said top flange for fixedly securing it to the nozzle support pad, said spider support member having a plurality of circumferentially spaced radially outwardly formed spider arms extending from said top flange to said peripheral flange, an annular support plate having opposite ends thereon with one end thereof secured to said peripheral flange, a combustor liner having one end telescoped into the opposite end of said support plate in radially inward spaced relationship therewith, convoluted spacer elements interposed between said combustor liner and said support plate having circumferentially spaced segments thereon secured to said combustor liner and support plate and flex segments between said fixed segments for yieldably supporting said liner on said support plate, a dome of porous material located concentrically within said support plate and having an inclined top in spaced parallelism with said spider arms, means for supporting said dome on said one end of said liner for free axial and radial movement with respect to said spider support plate with said spider support plate assuming the full vertical weight of said liner and dome and said dome being unloaded vertically to reduce stress loading thereof.

2. A combustor support assembly for vertically supporting axially aligned combustor dome and liner segments within an air supply plenum casing comprising a support member having a top flange with an opening adapted to receive a fuel distribution nozzle, means on said flange for securing it to the casing, said support having an inclined top and a peripheral side wall, a combustor liner having one end telescoped into the support, convoluted spacer element interposed between said combustion liner and said side wall having circumferentially spaced segments thereon secured to said combustor liner and said side wall and flex segments between said fixed segments for yieldably supporting said liner on said side wall, a dome of porous material located concentrically within said support member and having an inclined inlet end in spaced parallelism with said inclined top, means including a float ring on said dome for receiving a fuel nozzle secured to the casing and for supporting said dome on said one end of said liner for free axial and radial movement with respect to said support member with said support member assuming the full vertical weight of said liner and dome and said dome being unloaded vertically to reduce stress loading thereof.

* * * * *